US010822746B2

(12) United States Patent
Honggui et al.

(10) Patent No.: US 10,822,746 B2
(45) Date of Patent: Nov. 3, 2020

(54) WALLPAPER

(71) Applicant: E I DU PONT DE NEMOURS AND COMPANY, Wilmington, DE (US)

(72) Inventors: Zhang Honggui, Shanghai (CN); Donald Douglas May, Chadds Ford, PA (US)

(73) Assignee: DUPONT ELECTRONICS, INC., Wilmington, DE (US)

( * ) Notice: Subject to any disclaimer, the term of this patent is extended or adjusted under 35 U.S.C. 154(b) by 112 days.

(21) Appl. No.: 16/090,848

(22) PCT Filed: Apr. 26, 2017

(86) PCT No.: PCT/CN2017/081960

§ 371 (c)(1),
(2) Date: Oct. 3, 2018

(87) PCT Pub. No.: WO2017/186114

PCT Pub. Date: Nov. 2, 2017

(65) Prior Publication Data

US 2019/0106843 A1 Apr. 11, 2019

(30) Foreign Application Priority Data

Apr. 26, 2016 (CN) ..... 2016 1 0266253

(51) Int. Cl.

| | |
|---|---|
| ***D21H 27/20*** | (2006.01) |
| ***D21H 19/56*** | (2006.01) |
| ***D21H 19/58*** | (2006.01) |
| ***D21H 19/82*** | (2006.01) |
| ***D21H 19/40*** | (2006.01) |
| ***D21H 19/84*** | (2006.01) |

(52) U.S. Cl.

CPC ..... *D21H 27/20* (2013.01); *D21H 19/40* (2013.01); *D21H 19/56* (2013.01); *D21H 19/58* (2013.01); *D21H 19/822* (2013.01); *D21H 19/84* (2013.01)

(58) Field of Classification Search

USPC ..... 162/137

See application file for complete search history.

(56) References Cited

U.S. PATENT DOCUMENTS

2005/0233660 A1 10/2005 Kimbrell et al.

FOREIGN PATENT DOCUMENTS

| | | | |
|---|---|---|---|
| CN | 1942307 | A | 4/2007 |
| CN | 202626712 | U | 12/2012 |
| CN | 203960677 | U | 11/2014 |
| CN | 104328887 | A | 2/2015 |
| CN | 104395526 | A | 3/2015 |
| CN | 104514178 | A | 4/2015 |
| CN | 104514180 | A | 4/2015 |
| WO | 2015/055555 | A1 | 4/2015 |
| WO | 2017/186114 | A1 | 11/2017 |

OTHER PUBLICATIONS

CN 104328887, Cheng et al., machine translation, Feb. 2015.*

PCT International Search Report for Application No. PCT/CN2017/081960; Gao, Beibei, Authorized Officer; ISA/CN; dated Jul. 6, 2017.

* cited by examiner

*Primary Examiner* — Mark Halpern

(57) ABSTRACT

Disclosed herein is a wallpaper, including: (a) a paper substrate including a paper layer and an ink decorative layer attached to an upper surface of the paper layer that faces away from the wall during use; (b) a fluorine-containing coating attached to a surface of the ink decorative layer; and (c) a supporting layer attached to a lower surface of the paper substrate, in which the supporting layer comprises 25 to 45 wt % of polyacrylate, 25 to 40 wt % of a styrene-acrylic acid copolymer and 10 to 50 wt % of inorganic particles based on the total weight of the supporting layer, wherein the inorganic particles are selected from the group consisting of silicon dioxide, titanium dioxide, calcium carbonate, kaolin clay, diatomite and talc powder, and a combination of two or more thereof.

12 Claims, 1 Drawing Sheet

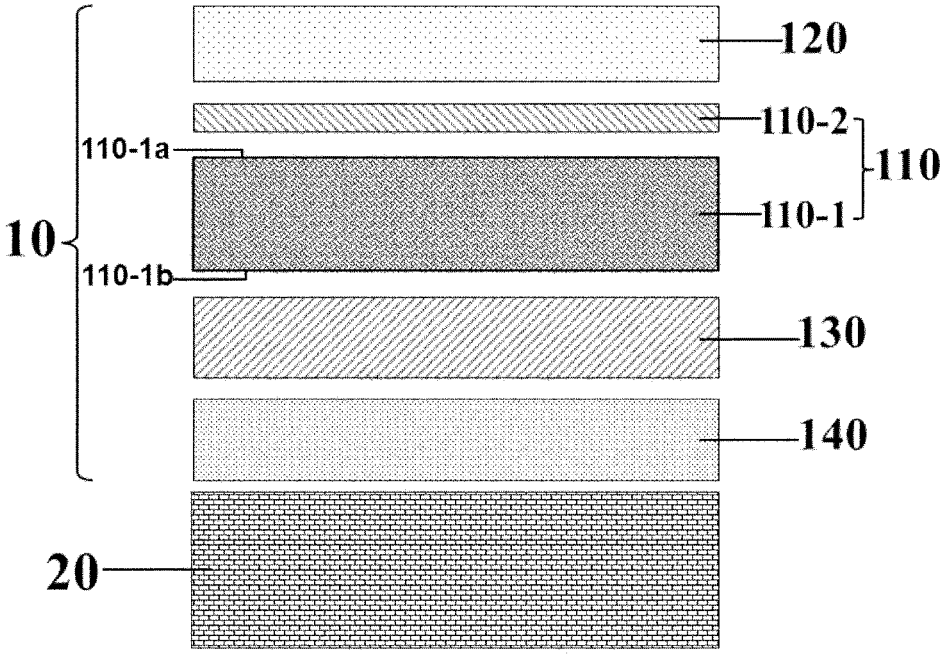
120
110-2
110
110-1a
110-1
10
110-1b
130
140
20

WALLPAPER

This application is a 371 of PCT/CN2017/081960 filed 26 Apr. 2017

TECHNICAL FIELD

The present disclosure relates to a curling-resistant, bubbling-resistant, mildewproof and durable wallpaper that is easy to clean.

BACKGROUND

At present, wallpaper is an important constituent of modern interior decorative materials, and is one of the main decorative materials for surfaces of indoor walls. Because wallpaper has good decorative effects, it is widely applied in indoor decoration. Common wallpaper is produced by printing out patterns with ink on the paper as a substrate. Common wallpaper suffers from disadvantages such as a lack of water resistance, susceptibility to mildew, and a lack of durability. In addition, wallpaper with a paper substrate requires on-site brush coating of an adhesive, and is prone to swelling due to water absorption and is susceptible to warping or bubble formation, which is inconvenient for construction during installation. Therefore, there remains a need for a curling-resistant, bubbling-resistant, mildewproof and durable wallpaper that is easy to clean.

SUMMARY

The present disclosure provides a wallpaper, including:

(a) a paper substrate, including a paper layer and an ink decorative layer attached to an upper surface of the paper layer that faces away from the wall during use;

(b) a fluorine-containing coating attached to a surface of the ink decorative layer; and (c) a supporting layer attached to a lower surface of the paper layer, in which the supporting layer comprises about 25 to 45 wt % of polyacrylate, about 25 to 45 wt % of a styrene-acrylic acid copolymer and about 10 to 50 wt % of inorganic particles based on the total weight of the supporting layer, wherein the inorganic particles are selected from a group consisting of silicon dioxide, titanium dioxide, calcium carbonate, kaolin clay, diatomite, talc powder, and a combination of two or more thereof.

In one embodiment, the fluorine-containing coating includes a fluorine-containing polymer, and the fluorine-containing polymer is selected from the group consisting of polyvinyl fluoride, polyvinylidene fluoride, a fluoroolefin-vinyl ether copolymer, a fluoroolefin-vinyl ester copolymer, and a combination of two or more thereof.

In another embodiment, based on the total weight of the fluorine-containing coating, the fluorine-containing coating includes about 80 to 99 wt % of a fluorine-containing polymer and about 1 to 20 wt % of a delustering agent; or includes about 82 to 97 wt % of a fluorine-containing polymer and about 3 to 18 wt % of a delustering agent; and the fluorine-containing coating has a thickness of about 3 to 30 μm.

In still another embodiment, the delustering agent is selected from a group consisting of silicon dioxide, titanium dioxide, kaolin clay, diatomite, and a combination of two or more thereof.

In one embodiment, the supporting layer has a thickness of about 5 to 50 μm.

In one embodiment, the paper layer has a thickness of about 145 to 240 and a basic weight of about 90 to 180 g/m$^2$.

In one embodiment, the ink decorative layer has a thickness of about 1 to 10 μm.

In one embodiment, the wallpaper further includes an adhesive layer, where the adhesive layer is located on one side of the waterproof layer facing away from the paper substrate and has a thickness of about 10 to 50 μm.

In another embodiment, the adhesive layer is produced from the adhesive selected from the group consisting of starch adhesive, sticky rice adhesive, acrylate pressure sensitive adhesive, epoxy adhesive and a combination of two or more thereof.

The present disclosure further provides a method for producing the above wallpaper, including:

(i) providing the paper substrate including the paper layer and an ink decorative layer attached to an upper surface of the paper layer;

(ii) providing a fluorine-containing composition, coating the fluorine-containing composition onto a surface of the ink decorative layer of the paper substrate, and drying, to produce the fluorine-containing coating;

(iii) providing a supporting layer composition, coating the supporting layer composition onto a lower surface of the paper layer, and drying, to produce the supporting layer; and (iv) optionally, providing a glue, coating the glue onto a surface of the supporting layer facing away from the paper substrate, and drying, to produce the adhesive layer, where the glue includes an adhesive dispersed in water.

According to the present disclosure, when a range is expressed with specific end points, it is to be understood that the range includes any value between the two specific end points and any value equal to or approximately equal to any one of the two end points.

DESCRIPTION OF THE DRAWINGS

FIG. 1 is a schematic cross section (not to scale) of one embodiment of wallpaper (10).

DETAILED DESCRIPTION

Unless otherwise defined, all technical and scientific terms as used herein have the same meaning as those commonly understood by one of ordinary skill in the art to which the present disclosure belongs. In case of conflict, the present specification, including definitions, will prevail.

Although methods and materials similar or equivalent to those described herein can be used in the practical use or testing of the present disclosure, suitable methods and materials are described in the present disclosure.

Unless otherwise stated, all percentages, parts, proportions and the like are based on weight.

When an amount, concentration, or other numerical value or parameter is given as either a range, a preferred range or a list of lower preferable values and upper preferable values, this is to be understood as specifically disclosing all ranges formed from any pair of any lower range limit or preferred value and any upper range limit or preferred value, regardless of whether ranges are separately disclosed. Where a range of numerical values is recited herein, unless otherwise stated, the range is intended to include the endpoints thereof, and all integers and fractions within the range. It is not intended that the scope of the present invention be limited to the specific values recited when defining a range.

When the term "about" is used in describing a numerical value or an endpoint of a range, the disclosure should be understood to include the specific value or end point that is referred.

As used herein, the terms "including," "comprising," "having," "have," "containing," "characterized by" or any other variation thereof are intended to cover a non-exclusive inclusion. For example, a process, method, article, or apparatus that comprises/includes a list of elements is not necessarily limited to only those elements but may further comprise/include other elements not expressly listed or inherent to such process, method, article, or apparatus. In addition, unless expressly stated to the contrary, "or" refers to an inclusive "or" and not to an exclusive "or".

The transitional phrase "consisting essentially of" limits the scope of a claim to the specified materials or steps and those that do not materially affect the basic and novel characteristic(s) of the claimed invention. Where applicants have defined the present invention or a portion thereof with an open-ended term such as "comprising/including," unless otherwise stated the description should be interpreted to also describe such an invention using the term "consisting essentially of".

Use of "a" or "an" are employed to describe elements and components of the present invention. This is merely for convenience and to give a general situation of the present invention. This description should be read to include one or at least one, and the singular also includes the plural unless it is obvious that it is meant otherwise.

In describing certain polymers, it is to be understood that sometimes applicants are referring to the polymers by the monomers used to prepare the polymers or the amounts of the monomers used to prepare the polymers. While such a description may not include the specific nomenclature used to describe the final polymer, or may not include product-by-process terminology, any such reference to monomers and amounts thereof should be interpreted to mean that the polymer comprises copolymerized units of those monomers or the amount of the monomers, and the corresponding polymers and compositions thereof.

The wallpaper (10) disclosed herein includes: (a) a paper substrate (110), including a paper layer (110-1) and an ink decorative layer (110-2) attached to an upper surface of the paper layer, where the upper surface (110-1*a*) of the paper layer faces away from the wall in use; (b) a fluorine-containing coating (120) attached to a surface of the ink decorative layer; and (c) a supporting layer (130) located on a lower surface (110-1*b*) of the paper layer. Further, the wallpaper further optionally includes an adhesive layer (140) located on one side of the supporting layer (130) facing away from the paper substrate (110), to provide an adhesive effect between the wallpaper (10) and a wall (20), see FIG. 1.

Paper Substrate (110)

The paper substrate (110) as disclosed herein includes a paper layer (110-1) and an ink decorative layer (110-2) attached to an upper surface of the paper layer, where the upper surface (110-1*a*) of the paper layer faces away from the wall during use.

The paper layer (110-1) has a continuous, thin and flat structure with a uniform thickness, and can be formed by monolayer paper or laminated multilayer paper. Typically, the monolayer paper refers to a thinner paper base material that may include conventional natural pulp paper and synthetic paper, where the synthetic paper is simulated paper prepared from synthetic resin films, and the paper base material is preferably a natural pulp paper made from wood pulp, such as softwood pulp, hardwood pulp and a mixed pulp of softwood pulp and hardwood pulp. The natural pulp may further optionally comprise various high molecular compounds or additives, such as dry strength enhancement agents, tackifiers, wet strength enhancement agents, stabilizers, pigments, dyes, fluorescent brightening agents, latexes, inorganic electrolytes, pH modifying agents and the like.

In one embodiment, the paper layer (110-1) is formed by monolayer paper, with a thickness of about 145 to 240 μm and a basic weight of about 90 to 180 g/m$^2$.

An ink decorative layer (110-2) is attached to an upper surface of the paper layer (110-1), and the ink decorative layer is an ink layer with colors and/or patterns to exert a decorative effect. Typically, the ink can be printed onto the surface of the paper layer (110-1) employing a printing machine, and inks that can be used in the printing generally comprise pigments, polymer resins and solvents. The ink is printed onto an upper surface of the paper substrate (110). In one embodiment, the ink decorative layer (110-2) has a thickness of about 1 to 3 μm.

Fluorine-Containing Coating (120)

The fluorine-containing coating as disclosed herein comprises a fluorine-containing polymer, and the fluorine-containing polymer includes, but is not limited to, polyvinyl fluoride, polyvinylidene fluoride, a fluoroolefin-vinyl ether copolymer, a fluoroolefin-vinyl ester copolymer, and a combination of two or more thereof. In one embodiment, the fluorine-containing polymer employed is polyvinyl fluoride.

The fluorine-containing coating as disclosed herein may further comprise about 80 to 99 wt % of a fluorine-containing polymer and about 1 to 20 wt % of a delustering agent, based on the total weight of the fluorine-containing coating. In one embodiment, based on the total weight of the fluorine-containing coating, the fluorine-containing coating comprises about 82 to 97 wt % of a fluorine-containing polymer and about 3 to 18 wt % of a delustering agent. In still another embodiment, based on the total weight of the fluorine-containing coating, the fluorine-containing coating comprises about 88 to 95 wt % of a fluorine-containing polymer and about 5 to 12 wt % of a delustering agent.

A fluorine-containing polymer employed as the fluorine-containing coating described herein is commercially available, for example, polyvinyl fluoride under a trade name Tedlar® produced by the U.S. Dupont Corporation (E.I. du Pont de Nemours and Company), or polyvinylidene fluoride under a trade name Kynar® produced by France Arkema Corporation (Arkema).

The addition of the delustering agent allows occurrence of diffuse reflection when incident light arrives at the wallpaper surface, i.e., the occurrence of scattering leads to sub-gloss and delustering appearance with a low gloss. Suitable delustering agents include, but are not limited to, silicon dioxide, titanium dioxide, kaolin clay, diatomite, and a combination of two or more thereof. The delustering agent may be spherical, spheroid, polygon, multi-rhombic, rod-shaped or have other irregular shapes. Generally, a particle diameter of the delustering agent is about 0.5 to 20 μm, or about 1 to 10 μm, or about 2 to 6 μm. As for the "particle diameter" herein, it means that, when the delustering agent is spherical, a diameter of the spherical delustering agent is the particle diameter thereof; and when the delustering agent is non-spherical, a diameter of a homogeneous sphere with a certain diameter that is closest in a certain physical characteristic or physical behavior (for example, passage of particles through a screen with a mesh size) to the delustering agent is considered as the particle diameter of the delustering agent. In one embodiment, the delustering agent employed is silicon dioxide.

The fluorine-containing coating can be prepared by any optional method, for example, a solution coating method, including: i) first adding a fluorine-containing polymer and a delustering agent into a suitable liquid dispersion medium, to prepare a fluorine-containing composition; ii) then applying the fluorine-containing composition to a surface of the ink decorative layer (110-2) of the paper substrate; iii) drying at a temperature of about 180° C. to 220° C. until the liquid dispersion medium is completely volatilized off.

Where, the suitable dispersion medium may be selected from the group consisting of propylene carbonate, N,N-dimethyl acetamide, isophorone, methyl pyrrolidone, xylene, ethylene glycol monobutyl ether and dimethyl phthalate and a mixture thereof; and in addition, the dispersion medium accounts for about 50 to 90 wt % based on the total weight of the fluorine-containing composition.

Where, suitable methods for applying the fluorine-containing composition include, but are not limited to, spray coating, blade coating, roller coating, air knife coating, gravure coating, hopper coating and round net coating.

In one embodiment, the fluorine-containing coating may be prepared by the following method, including: i) first adding polyvinyl fluoride and silicon dioxide into propylene carbonate, to prepare a fluorine-containing composition; ii) then roller coating the fluorine-containing composition onto a surface of the ink decorative layer (110-2) of the paper substrate using a wire wound coating roller; and iii) then placing into an oven for drying, at an oven temperature set at about 180° C. to 220° C. or about 195° C. to 210° C., for a time period of about 0.5 to 5 min or about 1 to 3 min.

In one embodiment, the fluorine-containing coating (120) may have a thickness of about 3 to 30 μm or about 8 to 12 μm.

Supporting Layer (130)

The supporting layer disclosed herein comprises about 25 to 45 wt % of polyacrylate, about 25 to 45 wt % of a styrene-acrylic acid copolymer and about 10 to 50 wt % of inorganic particles, based on the total weight of the supporting layer.

The supporting layer disclosed herein has an excellent water absorption effect, and the location thereof on the lower surface of the paper layer allows the wallpaper, according to the present invention, to have an improved water absorption rate, to prevent from swelling, warping or bubble formation subsequent to absorption of water from the glue by the paper layer itself.

The polyacrylate is a homopolymer or copolymer with acrylics as a monomer, and can be prepared through polymerization of an acrylate monomer under the action of an initiator.

The polystyrene acrylate is a copolymer of acrylate and styrene.

The inorganic particles are selected from the group consisting of silicon dioxide, titanium dioxide, calcium carbonate, kaolin clay, diatomite, talc powder, and a combination of two or more thereof. The inorganic particles may be spherical, spheroid, polygon, multi-rhombic, rod-shaped or have other irregular shapes; and the particle diameter thereof is about 0.5 to 20 μm, or about 1 to 10 μm, or about 2 to 6 μm. In one embodiment, the inorganic particles employed are silicon dioxide.

The supporting layer can be prepared by any optional method, for example, an emulsion coating method, including: i) mixing polyacrylate, a styrene-acrylic acid copolymer and inorganic particles with water as a dispersion medium, to prepare a supporting layer composition; ii) applying the supporting layer composition to a lower surface of the paper layer; and iii) drying at a temperature of about 85° C. to 120° C. until water is completely volatilized off.

In one embodiment, based on the total weight of the supporting layer composition, the supporting layer composition comprises about 15 to 25 wt % of polyacrylate, about 15 to 25 wt % of polystyrene acrylate, about 1 to 20 wt % of inorganic particles, and about 40 to 60 wt % of water.

Where, suitable methods for applying the supporting layer composition include, but are not limited to, spray coating, blade coating, roller coating, air knife coating, gravure coating, hopper coating and round net coating.

In one embodiment, the supporting layer may be prepared by the following method, including: i) first mixing polyacrylate, a styrene-acrylic acid copolymer and inorganic particles with water as a dispersion medium, to prepare a supporting layer composition; ii) then roller coating the supporting layer composition onto a lower surface of the paper substrate using a wire wound coating roller; and iii) then placing into an oven for drying, at an oven temperature set at about 85° C. to 120° C., for a time period of about 1 to 10 min.

Materials employed as the supporting layer composition herein are commercially available, for example, a polyacrylate emulsion or a styrene-acrylic acid copolymer emulsion under the trade name Viscopol™ produced by Australia Nuplex Corporation (Nuplex).

In one embodiment, the supporting layer composition has a thickness of about 5 to 30 μm or about 8 to 20 μm.

Adhesive Layer (140)

It is to be understood that, in addition to the above paper substrate (110), fluorine-containing coating (120) and supporting layer (130), the wallpaper (10) disclosed herein further optionally includes an adhesive layer (140) located on one side of the supporting layer (130) facing away from the paper substrate (110), to provide an adhesive effect between the wallpaper (10) and a wall (20).

The adhesive layer used herein can be formed by any suitable adhesive. For example, the adhesives include, but are not limited to, starch adhesive, sticky rice adhesive, acrylate pressure sensitive adhesive, epoxy adhesive and a combination of two or more thereof.

The adhesive layer can be prepared by any optional method, for example, a solution coating method, including: i) mixing an adhesive and water, to prepare a glue; ii) applying the glue to a surface on one side of the supporting layer (130) facing away from the paper substrate (110); and iii) drying at a temperature of about 85° C. to 120° C. until water is completely volatilized off.

Where, based on the total weight of the glue, the glue comprises about 10 to 60 wt % of the adhesive and about 40 to 90 wt % of water.

Where, suitable methods for applying the glue include, but are not limited to, spray coating, blade coating, roller coating, air knife coating, gravure coating, hopper coating and round net coating.

In one embodiment, the adhesive layer may be prepared by the following method, including: i) first mixing an adhesive and water, to prepare a glue; ii) then applying the glue to a surface on one side of the supporting layer (130) facing away from the paper substrate (110) using a wire wound coating roller; and iii) then placing into an oven for drying, at an oven temperature set at about 85° C. to 120° C., for a time period of about 1 to 10 min.

In one embodiment, the wallpaper further includes an adhesive layer that is located on one side of the supporting layer (130) facing away from the paper substrate (110) and has a thickness of about 10 to 50 μm.

The present disclosure further provides a method for producing the wallpaper. The wallpaper (10) according to the present disclosure can be prepared by any suitable method.

In one embodiment, the method for producing the wallpaper includes:

(i) providing the paper substrate including a paper layer and an ink decorative layer attached to an upper surface of the paper layer;

(ii) providing a fluorine-containing composition, and coating the fluorine-containing composition onto a surface of the ink decorative layer of the paper substrate, and drying, to prepare the fluorine-containing coating;

(iii) providing a supporting layer composition, and coating the supporting layer composition onto a lower surface of the paper substrate, and drying, to prepare the supporting layer; and (iv) optionally, providing a glue, coating the glue onto a surface of the supporting layer facing away from the paper substrate, and drying, to produce the adhesive layer, where the glue includes an adhesive dispersed in water.

The wallpaper disclosed herein has advantages in that it is curling-resistant, bubbling-resistant, mildewproof, durable, easy to clean, easy to install and has a sub-gloss effect.

Because a supporting layer containing polyacrylate, a styrene-acrylic acid copolymer and inorganic particles is comprised, the wallpaper according to the present invention can be firmly adhered to a wall without curling deformation, and has excellent curling resistance. In addition, the supporting layer as disclosed has an excellent water absorption effect, and the location thereof on the lower surface of the paper layer allows the wallpaper according to the present invention to have an improved water absorption rate, to prevent from swelling, warping or bubble formation subsequent to absorption of water from the glue by the paper layer itself.

As a result of inclusion of a fluorine-containing coating formed by a fluorine-containing polymer, a dense protection layer is formed on the surface of the wallpaper, so that the surface of the wallpaper according to the present invention will not support the growth of mildew and bacteria, will have good mildewproof and waterproof effects, can also effectively resist various oil stains and scrawls, and even stubborn stains can be easily removed with an appropriate detergent. The fluorine-containing coating further has excellent abrasive resistance and rub resistance, and can effectively prevent color fading on the decorative surface and prolong service life of the wallpaper. Because the fluorine-containing coating can further comprise a delustering agent, diffuse reflection occurs when incident light arrives at the wallpaper surface, leading to a sub-gloss and delustering appearance with a low gloss.

EXAMPLES

Materials:

PVF (Polyvinyl Fluoride) Dispersion:

a polyvinyl fluoride dispersion available from Dupont under a trade name Tedlar® 44-1010, comprising about 45 wt % of polyvinyl fluoride and about 55 wt % of propylene carbonate;

Acrylic (Polyacrylate) Emulsion:

a polyacrylate emulsion available from Australia Nuplex Corporation (Nuplex) under a trade name Viscopol™ 9052, comprising about 48 wt % of polyacrylate and about 52 wt % of water;

PSA (Styrene-Acrylic Acid Copolymer) Emulsion:

a polystyrene-acrylic acid copolymer emulsion available from Australia Nuplex Corporation (Nuplex) under a trade name Viscopol™ 6180, comprising about 48 wt % of a styrene-acrylic acid copolymer and about 52 wt % of water;

Paper (Paper Substrate):

a paper substrate for use in wallpaper available from Finland Metsa Board Corporation under a trade name Cresta™, having a thickness of about 200 μm and a basic weight of about 150 g/m$^2$; as well as an ink decorative layer with a thickness of about 2 μm printed on the surface thereof; and $SiO_2$ (Silicon Dioxide):

spherical silicon dioxide particles available from U.S. Grace Corporation (Grace) under a trade name Syloid™ 308, with an average particle diameter of about 3 to 5 μm.

Comparative Example 1 and Examples 1 to 4

Comparative Example 1

4.75 g of $SiO_2$ (silicon dioxide) particles were added into 200 g of a PVF dispersion, and then stirred for 30 min at a rotation rate of 1000 r/min by using a mechanical stirrer, to obtain a PVF dispersion containing $SiO_2$ particles. Then, the above dispersion was coated, using a roll coating machine, onto an upper surface of Paper (paper substrate) on which an ink decorative layer had been printed, then the paper was placed into an oven at a condition of 190° C. to carry out drying for about 2 min, thereby propylene carbonate in the dispersion was evaporated off, to obtain a fluorine-containing coating with a thickness of about 8 μm coated on the upper surface of Paper (paper substrate), where $SiO_2$ accounted for 5 wt % based on the total weight of the coating. Subsequently, 100 g of the Acrylic (polyacrylate) emulsion was added into 100 g of the PSA (styrene-acrylic acid copolymer) emulsion, and then stirred for 10 min at a condition of a rotation rate at 500 r/min by using a mechanical stirrer, to obtain an Acrylic-PSA mixed emulsion. The Acrylic-PSA mixed emulsion was coated uniformly, from top to bottom, onto a lower surface of Paper (paper substrate) by using a 60-μm wire rod, and then the paper was placed into an oven at a condition of 110° C. to carry out drying for about 2 min, thereby water in the Acrylic-PSA mixed emulsion was evaporated off, to obtain a supporting layer with a thickness of about 30 μm coated on the lower surface of Paper (paper substrate). The structure of the wallpaper obtained is represented by "PVF($SiO_2$)/Paper/APSA."

Example 1

4.75 g of $SiO_2$ (silicon dioxide) particles were added into 200 g of a PVF dispersion, and then stirred for 30 min at a rotation rate of 1000 r/min by using a mechanical stirrer, to obtain a PVF dispersion containing $SiO_2$ particles. Then, the above dispersion was coated, using a roll coating machine, onto an upper surface of Paper (paper substrate) on which an ink decorative layer had been printed, then the paper was placed into an oven at a condition of 190° C. to carry out drying for about 2 min, thereby propylene carbonate in the dispersion was evaporated off, to obtain a fluorine-containing coating with a thickness of about 8 μm coated on the upper surface of Paper (paper substrate), where $SiO_2$ accounted for 5 wt % based on the total weight of the coating. Subsequently, 100 g of the Acrylic (polyacrylate) emulsion was added into 100 g of the PSA (styrene-acrylic acid copolymer) emulsion, then stirred at a condition of a rotation rate at 500 r/min by using a mechanical stirrer, and at the same time 10 g of $SiO_2$ particles were added therein followed by stirring for 20 min, to obtain an Acrylic-PSA-$SiO_2$ mixed emulsion. The Acrylic-PSA-$SiO_2$ mixed emulsion was coated uniformly, from top to bottom, onto a lower surface of Paper (paper substrate) by using a 60-μm wire rod, and then the paper was placed into an oven at a condition of 110° C. to carry out drying for about 2 min, thereby water in the Acrylic-PSA-$SiO_2$ mixed emulsion was evaporated off, to obtain a supporting layer with a thickness of about 30 μm coated on the lower surface of Paper (paper substrate), where $SiO_2$ accounted for about 9 wt % based on the total weight of the supporting layer. The structure of the wallpaper obtained is represented by "PVF($SiO_2$)/Paper/APSA($SiO_2$)-1."

Example 2

4.75 g of $SiO_2$ (silicon dioxide) particles were added into 200 g of a PVF dispersion, and then stirred for 30 min at a rotation rate of 1000 r/min by using a mechanical stirrer, to obtain a PVF dispersion containing $SiO_2$ particles. Then, the above dispersion was coated, using a roll coating machine, onto an upper surface of Paper (paper substrate) on which an ink decorative layer had been printed, then the paper was placed into an oven at a condition of 190° C. to carry out drying for about 2 min, thereby propylene carbonate in the dispersion was evaporated off, to obtain a fluorine-containing coating with a thickness of about 8 μm coated on the upper surface of Paper (paper substrate), where $SiO_2$ accounted for 5 wt % based on the total weight of the coating. Subsequently, 100 g of the Acrylic (polyacrylate) emulsion was added into 100 g of the PSA (styrene-acrylic acid copolymer) emulsion, then stirred at a condition of a rotation rate at 500 r/min by using a mechanical stirrer, and at the same time 20 g of $SiO_2$ particles were added therein followed by stirring for 20 min, to obtain an Acrylic-PSA-$SiO_2$ mixed emulsion. The Acrylic-PSA-$SiO_2$ mixed emulsion was coated uniformly, from top to bottom, onto a lower surface of Paper (paper substrate) by using a 60-μm wire rod, and then the paper was placed into an oven at a condition of 100° C. to carry out drying for about 2 min, thereby water in the Acrylic-PSA-$SiO_2$ mixed emulsion was evaporated off, to obtain a supporting layer with a thickness of about 30 μm coated on the lower surface of Paper (paper substrate), where $SiO_2$ accounted for about 17 wt % based on the total weight of the supporting layer. The structure of the wallpaper obtained is represented by "PVF ($SiO_2$)/Paper/APSA ($SiO_2$)-2."

Example 3

4.75 g of $SiO_2$ (silicon dioxide) particles were added into 200 g of a PVF dispersion, and then stirred for 30 min at a rotation rate of 1000 r/min by using a mechanical stirrer, to obtain a PVF dispersion containing $SiO_2$ particles. Then, the above dispersion was coated, using a roll coating machine, onto an upper surface of Paper (paper substrate) on which an ink decorative layer had been printed, then the paper was placed into an oven at a condition of 190° C. to carry out drying for about 2 min, thereby propylene carbonate in the dispersion was evaporated off, to obtain a fluorine-containing coating with a thickness of about 8 μm coated on the upper surface of Paper (paper substrate), where $SiO_2$ accounted for 5 wt % based on the total weight of the coating. Subsequently, 100 g of the Acrylic (polyacrylate) emulsion was added into 100 g of the PSA (styrene-acrylic acid copolymer) emulsion, then stirred at a condition of a rotation rate at 500 r/min by using a mechanical stirrer, and at the same time 30 g of $SiO_2$ particles were added therein followed by stirring for 20 min, to obtain an Acrylic-PSA-$SiO_2$ mixed emulsion; for 10 min, to obtain an Acrylic-PSA-$SiO_2$ mixed emulsion. The Acrylic-PSA-$SiO_2$ mixed emulsion was coated uniformly, from top to bottom, onto a lower surface of Paper (paper substrate) by using a 60-μm wire rod, and then the paper was placed into an oven at a condition of 110° C. to carry out drying for about 2 min, thereby water in the Acrylic-PSA-$SiO_2$ mixed emulsion was evaporated off, to obtain a supporting layer with a thickness of about 20 μm coated on the lower surface of Paper (paper substrate), where $SiO_2$ accounted for about 23 wt % based on the total weight of the supporting layer. The structure of the wallpaper obtained is represented by "PVF($SiO_2$)/Paper/APSA($SiO_2$)-3."

Example 4

4.75 g of $SiO_2$ (silicon dioxide) particles were added into 200 g of a PVF dispersion, and then stirred for 30 min at a rotation rate of 1000 r/min by using a mechanical stirrer, to obtain a PVF dispersion containing $SiO_2$ particles. Then, the above dispersion was coated, using a roll coating machine, onto an upper surface of Paper (paper substrate) on which an ink decorative layer had been printed, then the paper was placed into an oven at a condition of 190° C. to carry out drying for about 2 min, thereby propylene carbonate in the dispersion was evaporated off, to obtain a fluorine-containing coating with a thickness of about 8 μm coated on the upper surface of Paper (paper substrate), where $SiO_2$ accounted for 5 wt % based on the total weight of the coating. Subsequently, 100 g of the Acrylic (polyacrylate) emulsion was added into 100 g of the PSA (styrene-acrylic acid copolymer) emulsion, then stirred at a condition of a rotation rate at 500 r/min by using a mechanical stirrer, and at the same time 40 g of $SiO_2$ particles were added therein followed by stirring for 20 min, to obtain an Acrylic-PSA-$SiO_2$ mixed emulsion. The Acrylic-PSA-$SiO_2$ mixed emulsion was coated uniformly, from top to bottom, onto a lower surface of Paper (paper substrate) by using a 60-μm wire rod, and then the paper was placed into an oven at a condition of 100° C. to carry out drying for about 2 min, thereby water in the Acrylic-PSA-$SiO_2$ mixed emulsion was evaporated off, to obtain a supporting layer with a thickness of about 20 μm coated on the lower surface of Paper (paper substrate), where $SiO_2$ accounted for about 29 wt % based on the total weight of the supporting layer. The structure of the wallpaper obtained is represented by "PVF($SiO_2$)/Paper/APSA($SiO_2$)-4."

Structures of various Comparative examples and Examples are listed in Table 1.

Testing Methods

Properties of wallpapers of various Comparative examples and Examples were tested respectively according to the following methods.

Water Absorption Rate:

A 10×10 cm wallpaper sample was taken by cutting it with scissors, and the weight of the wallpaper sample measured. 6-cm deep water was charged into a wide mouthed bottle with a caliber of 8.5 cm and a height of 7 cm, and then the wide mouthed bottle was placed upside down onto a surface of the supporting layer of the wallpaper sample. 20 min later, the wide mouthed bottle was removed from the surface of the supporting layer, and excess liquid water was wiped away with absorbent paper. The sample weight was weighed immediately. The water absorption rate of the wallpaper sample can be obtained by subtracting the original sample weight from the sample weight after water absorption, followed by dividing by the sample area. Each group had at least 3 samples, and values thereof were averaged. The unit of the water absorption rate is $g/m^2$, and a higher numerical value thereof indicates better water absorption of the wallpaper, and better curling resistance and bubbling-resistance during the application course of the wallpaper.

Cleanability:

A4-sized wallpaper samples were taken by cutting them with scissors and laid flat on top of a table. Shoe cream, coffee, a water color pen, a ball pen, a permanent marker and a lipstick employed as blot sources were smeared onto the surface of the fluorine-containing coating of the wallpaper samples, and the samples were placed for 24 h to natural dry. Wiping was carried out using 95% alcohol. If all the blots were wiped off completely, the cleanability thereof was defined as "+"; and if there were traces remaining, the cleanability was defined as "−".

Durability:

Durability of the wallpaper was tested according to the ASTM D4060 standard, using a Taber Abraser abrasion resistance tester, employing a DS-10 friction wheel under a 500-g load to subject the surface of the fluorine-containing coating of the wallpaper sample to friction for 100 revolutions. The abrasion condition of the ink decorative layer of the wallpaper was observed. If the ink layer of the decorative layer had no abrasion visible to the naked eyes, the durability thereof was defined as "+"; and if abrasion was visible to the naked eyes, the durability was defined as "−".

Mildewproof Performance:

A nutrient medium susceptible to growth of mildew was sufficiently and uniformly smeared onto a surface of the fluorine-containing coating of the wallpaper sample, and cultured for 5 days at a condition including a temperature of 28° C. and a relative humidity greater than 90%. If there was growth of mildew visible to the naked eyes, the mildewproof performance thereof was defined as "−"; and if there was no growth of mildew visible to the naked eyes, the mildewproof performance was defined as "+".

Structures and properties known through tests of various Comparative examples and Examples are listed in Table 1.

TABLE 1

| | Structure | Water absorption rate ($g/m^2$) | Cleanability | Durability | Mildew proof performance |
|---|---|---|---|---|---|
| Comparative example 1 | PVF($SiO_2$)/Paper/APSA | 1.32 | + | + | + |
| Example 1 | PVF($SiO_2$)/Paper/APSA($SiO_2$)-1 | 2.11 | + | + | + |
| Example 2 | PVF($SiO_2$)/Paper/APSA($SiO_2$)-2 | 2.22 | + | + | + |
| Example 3 | PVF($SiO_2$)/Paper/APSA($SiO_2$)-3 | 2.43 | + | + | + |
| Example 4 | PVF($SiO_2$)/Paper/APSA($SiO_2$)-4 | 6.52 | + | + | + |

[a]"/" is used to separate each different layer from an adjacent layer.

Results confirm that, as compared with the wallpaper in Comparative example 1, about 9 wt %, about 17 wt %, about 23 wt % and about 29 wt % of silicon dioxide particles were incorporated respectively into supporting layers of wallpapers in Examples 1 to 4, to allow the water absorption rates thereof to improve by about 60%, about 68%, about 84% and about 394%, respectively. Therefore, when inorganic particles of silicon dioxide were incorporated into the supporting layers, water absorption rates of the wallpapers were significantly improved, and thereby the curling resistance and bubbling resistance during the application course of the wallpaper were significantly improved. As compared with Comparative example 1, cleanability, durability, and mildew proof performance of the wallpapers of Examples 1 to 4 were also maintained very well.

What is claimed is:

1. A wallpaper, comprising:

(a) a paper substrate, comprising a paper layer and an ink decorative layer attached to an upper surface of the paper layer that faces away from the wall during use;

(b) a fluorine-containing coating attached to a surface of the ink decorative layer; and (c) a supporting layer attached to a lower surface of the paper layer, in which the supporting layer comprises 25 to 45 wt % of polyacrylate, 25 to 40 wt % of a styrene-acrylic acid copolymer and 10 to 50 wt % of inorganic particles based on the total weight of the supporting layer, wherein the inorganic particles have a particle diameter of 2 to 6 μm and are selected from a group consisting of silicon dioxide, titanium dioxide, calcium carbonate, kaolin clay, diatomite, talc powder, and a combination of two or more thereof.

2. The wallpaper of claim 1, wherein, the fluorine-containing coating comprises a fluorine-containing polymer selected from the group consisting of polyvinyl fluoride, polyvinylidene fluoride, a fluoroolefin-vinyl ether copolymer, a fluoroolefin-vinyl ester copolymer, and a combination of two or more thereof.

3. The wallpaper of claim 1, wherein, the fluorine-containing coating comprises 80 to 99 wt % of a fluorine-containing polymer and 1 to 20 wt % of a delustering agent based on the total weight of the fluorine-containing coating; and the fluorine-containing coating has a thickness of 3 to 30 μm.

4. The wallpaper of claim 3, wherein the delustering agent is selected from a group consisting of silicon dioxide, titanium dioxide, kaolin clay, diatomite, and a combination of two or more thereof.

5. The wallpaper of claim 1, wherein, the supporting layer has a thickness of 5 to 50 μm.

6. The wallpaper of claim 1, wherein the paper layer has a thickness of 145 to 240 μm, and a basic weight of 90 to 180 $g/m^2$.

7. The wallpaper of claim 1, wherein the ink decorative layer has a thickness of 1 to 10 μm.

8. The wallpaper of claim 1, further comprising an adhesive layer that is located on one side of the supporting layer facing away from the paper substrate and has a thickness of 10 to 50 μm.

9. The wallpaper of claim 8, wherein the adhesive layer is produced from the adhesive selected from the group consisting of starch adhesive, sticky rice adhesive, acrylate pressure sensitive adhesive, epoxy adhesive and a combination of two or more thereof.

10. A method for producing the wallpaper of any one of claims 1 to 9, comprising:

(i) providing the paper substrate comprising a paper layer and an ink decorative layer attached to an upper surface of the paper layer;

(ii) providing a fluorine-containing composition, coating the fluorine-containing composition onto a surface of the ink decorative layer of the paper substrate, and drying, to produce the fluorine-containing coating;

(iii) providing a supporting layer composition, coating the supporting layer composition onto a lower surface of the paper layer, and drying, to produce the supporting layer; and (iv) optionally, providing a glue, coating the glue onto a surface of the supporting layer facing away from the paper substrate, and drying, to produce the adhesive layer, wherein the glue includes an adhesive dispersed in water.

11. A wallpaper, comprising:

(a) a paper substrate, comprising a paper layer and an ink decorative layer attached to an upper surface of the paper layer that faces away from the wall during use;

(b) a fluorine-containing coating comprising a fluorine-containing polymer attached to a surface of the ink decorative layer, wherein the fluorine-containing polymer comprises polyvinyl fluoride, a fluoroolefin-vinyl ether copolymer, a fluoroolefin-vinyl ester copolymer or a combination of two or more thereof; and (c) a supporting layer attached to a lower surface of the paper layer, in which the supporting layer comprises 25 to 45 wt % of polyacrylate, 25 to 40 wt % of a styrene-acrylic acid copolymer and 10 to 50 wt % of inorganic particles based on the total weight of the supporting layer, wherein the inorganic particles are selected from a group consisting of silicon dioxide, titanium dioxide, calcium carbonate, kaolin clay, diatomite, talc powder, and a combination of two or more thereof.

12. The wallpaper of claim 11, wherein the fluorine-containing polymer further comprises polyvinylidene fluoride.

* * * * *